US006681442B2

(12) United States Patent
Coates et al.

(10) Patent No.: US 6,681,442 B2
(45) Date of Patent: Jan. 27, 2004

(54) APPARATUS AND METHOD FOR CLEANING A SURFACE

(75) Inventors: Donald A. Coates, Canton, OH (US); Robert W. Bauman, North Canton, OH (US); Michael A. Durbin, Massillon, OH (US); Evan A. Gordon, North Canton, OH (US); Adam C. Sclafani, North Canton, OH (US); Aaron P. Tondra, North Canton, OH (US); William H. Theiss, Jr., Canton, OH (US)

(73) Assignee: The Hoover Company, North Canton, OH (US)

( * ) Notice: Subject to any disclaimer, the term of this patent is extended or adjusted under 35 U.S.C. 154(b) by 305 days.

(21) Appl. No.: 09/861,956

(22) Filed: May 21, 2001

(65) Prior Publication Data

US 2003/0135952 A1 Jul. 24, 2003

(51) Int. Cl.[7] ..... A47L 11/20; A47L 11/30
(52) U.S. Cl. ..... 15/320
(58) Field of Search ..... 15/320, 340.1, 15/340.2, 340.3, 340.4

(56) References Cited

U.S. PATENT DOCUMENTS

| | | | | | |
|---|---|---|---|---|---|
| 3,101,505 | A | | 8/1963 | Belicka et al. | 15/320 |
| 4,014,067 | A | | 3/1977 | Bates | 15/320 |
| 4,295,243 | A | | 10/1981 | King | 15/320 |
| 4,558,823 | A | | 12/1985 | Groth | 239/413 |
| 4,570,856 | A | | 2/1986 | Groth et al. | 239/310 |
| 4,956,891 | A | | 9/1990 | Wulff | 15/320 |
| 5,180,439 | A | | 1/1993 | Allison | 134/21 |
| 5,867,857 | A | * | 2/1999 | Crouser et al. | 15/50.1 |
| 5,937,475 | A | | 8/1999 | Kasen et al. | 15/320 |
| 6,108,862 | A | | 8/2000 | Frederick et al. | 15/340.2 |
| 6,131,237 | A | * | 10/2000 | Kasper et al. | 15/320 |
| 6,134,744 | A | * | 10/2000 | Kasen et al. | 15/320 |
| 6,247,202 | B1 | * | 6/2001 | Lesco et al. | 15/320 |
| 6,279,196 | B2 | * | 8/2001 | Kasen et al. | 15/320 |
| 6,446,302 | B1 | * | 9/2002 | Kasper et al. | 15/319 |
| 2002/0092116 | A1 | * | 7/2002 | Zahuranec et al. | 15/320 |

* cited by examiner

*Primary Examiner*—Terrence R. Till
(74) *Attorney, Agent, or Firm*—A. Burgess Lowe; Brett A. Schenck

(57) ABSTRACT

A cleaner for cleaning a surface comprises a floor-engaging portion for moving along the surface. A source supplies a liquid to a distributor, which distributes the liquid from the source on the surface wherein an activating device is operatively connected to the source to activate the source to supply liquid to the distributor to distribute liquid on the surface in response to a force moving the floor engaging portion in a first direction.

24 Claims, 11 Drawing Sheets

APPARATUS AND METHOD FOR CLEANING A SURFACE

BACKGROUND OF THE INVENTION

1. Field of the Invention

The present invention relates to an apparatus and method for cleaning a surface. More particularly, the present application pertains to a carpet extractor that can clean the carpet using one cleaning mode on the forward stroke of a cleaning cycle and then clean the carpet using another cleaning mode on the reverse stroke of a cleaning cycle without an extra operation.

2. Background Information

It is known in the prior art to provide a carpet extractor in which cleaning solution is dispensed to a carpeted surface and substantially simultaneously extracted along with the dirt on the carpet in a continuous operation. For example, U.S. Pat. No. 5,500,977 issued to McAllise et al. discloses such a carpet extractor. Specifically, as depicted in FIG. 8B of this patent, when extractor 10 is operated in the floor cleaning mode to clean the carpet, cleaning solution, upon the operator's command, is discharged from the cleaning fluid supply tank 40, passing through the supply line 328, and into the fluid distributor 650 positioned within air discharge nozzle 65 whereby the cleaning fluid is atomizingly distributed throughout the discharged air and conveyed thereby to the carpet being cleaned. Simultaneously, working air, including cleaning fluid and dirt from the carpet, is drawn into floor nozzle 70, through floor conversion module 526, air/fluid separator lid 55 and into the recovery tank 510. Warm, moist exhaust air, from motor fan 610, is discharged through discharge nozzle 65 and directed toward the surface being cleaned. Thus, the upright carpet extractor applies and/or extracts the cleaning solution on the both the forward and reverse stroke.

Usually for this type of extractor, the detergent concentration in the cleaning solution is not at a high amount that will leave a white detergent residue on the carpet from the dried cleaning solution not extracted. Such a residue conditions the carpet to create a high potential for dirt to deposit on the carpet. Yet, it may be desirable to use such a high amount of detergent concentration on the carpet on either the reverse or forward stroke, for example, to clean it when it is very dirty or soiled.

It is known that some of these carpet extractors have a variable mixing valve to permit varying the water/detergent mixture ratios to accommodate a wide variety of cleaning situations. One such cleaner is illustrated by U.S. Pat. No. 5,937,475 issued to Kasen. This valve is manually controlled by a knob provided on the outside of an upper housing pivotally mounted to the base assembly. However, during operation of the extractor, a user must stop cleaning to move to a position to operate the knob if he wants to change the water/detergent mixture ratio for a different cleaning situation. This proves to be quite inconvenient for the user, especially if, for example, a user wants to apply cleaning fluid on the forward stroke to wash the carpet and clean water on the reverse stroke to rinse the carpet. In addition to operation of the knob, activation of a button, lever or other switching device on the handle to apply the cleaning solution to the carpet requires another operation by a user as he or she moves the suction cleaner along the floor to clean it.

Hence, it is an object of the present invention to provide a convenient, ergonomically design apparatus on a carpet extractor that can clean the carpet or floor using one cleaning mode on the forward stroke of a cleaning cycle and another cleaning mode for the reverse stroke of the cleaning cycle.

It is another object of the present invention to provide a method of cleaning a carpet or floor using one cleaning mode on the forward stroke of a cleaning cycle and another cleaning mode on the reverse stroke of the cleaning cycle.

It is another object of the present invention to provide an apparatus on a carpet extractor that selects a cleaning cycle to clean the carpet or floor.

It is another object of the present invention to provide an apparatus and method on a carpet extractor that improves the cleaning performance.

SUMMARY OF THE INVENTION

The foregoing and other objects of the present invention will be readily apparent from the following description and the attached drawings. In one embodiment of the present invention, a cleaner for cleaning a surface comprises a floor-engaging portion for moving along the surface. A source supplies a liquid to a distributor, which distributes the liquid from the source onto the surface. An activating device operatively connected to the source activates the source to supply liquid to the distributor to distribute liquid on the surface in response to a force moving the floor-engaging portion in a first direction.

BRIEF DESCRIPTION OF THE DRAWINGS

The invention will now be described, by way of example, with reference to the attached drawings, of which.

DETAILED DESCRIPTION OF THE INVENTION

Figure 1:
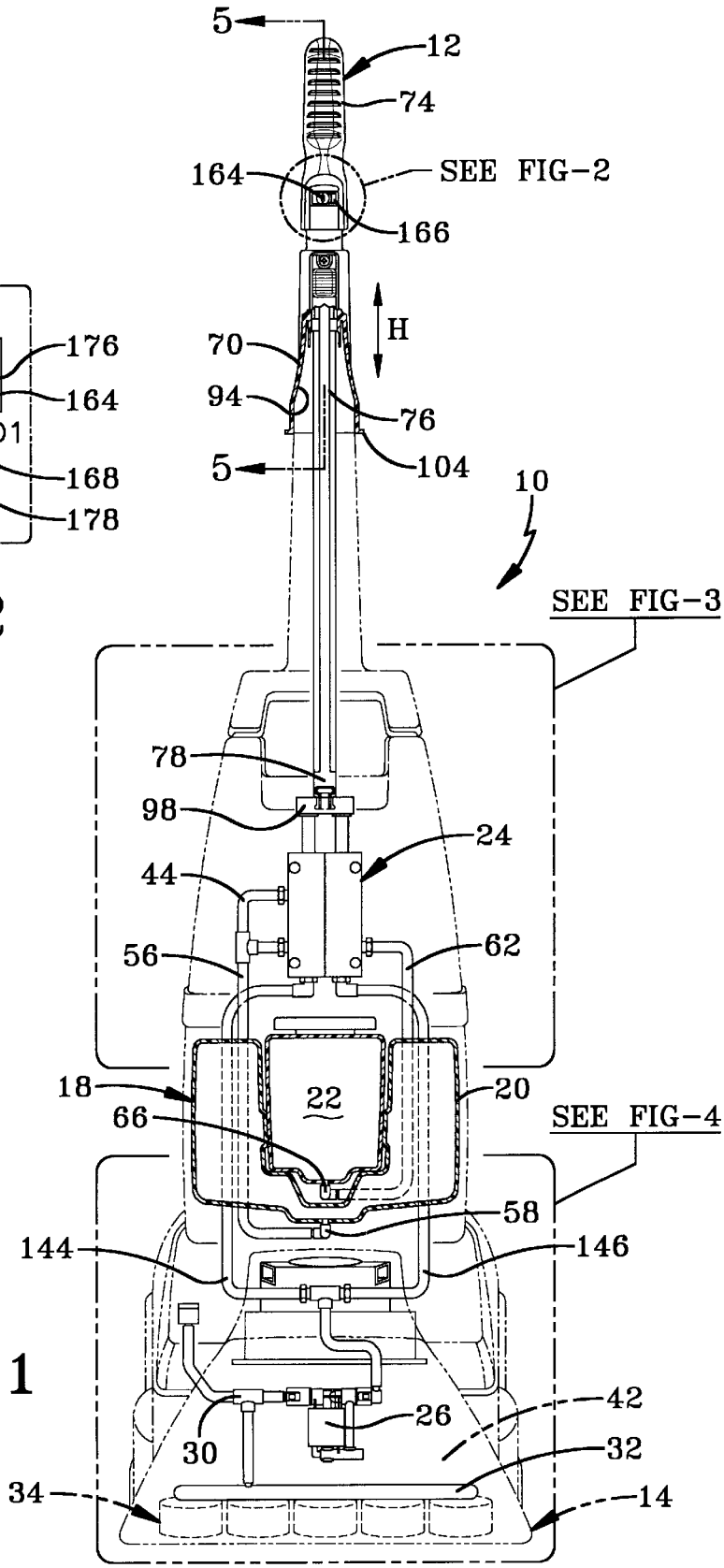
FIG. 1 is a diagrammatic partial, front sectional view of a carpet extractor incorporating a fluid distribution system according to the present invention.

In one embodiment of the present invention, a fluid supply system is provided in an upright style carpet extractor 10 as diagrammatically illustrated in FIG. 1. The upright carpet extractor 10 includes a pivotal handle portion 12 for propelling a floor-engaging portion or foot 14 over a carpeted floor. The floor-engaging portion 14 includes a brush assembly 34 having a plurality of rotating scrub brushes 16 (FIG. 4) for scrubbing the floor. A supply tank assembly 18 is mounted to the floor-engaging portion 14 of the extractor. The supply tank assembly 18 comprises a clean water supply tank 20 and a detergent supply tank 22, which nests into an open area formed by surrounding portions of the clean water tank 20. It should be noted that the supply tanks 20, 22 could alternatively be located adjacent one another in a side-by-side relationship. The clean water and detergent are drawn from their respective tanks 20, 22 to a valve assembly 24 through operation of a pump 26. The cleaning liquid comprising the detergent and/or clean water from the valve assembly 24 travels to the pump 26.

Figure 4:
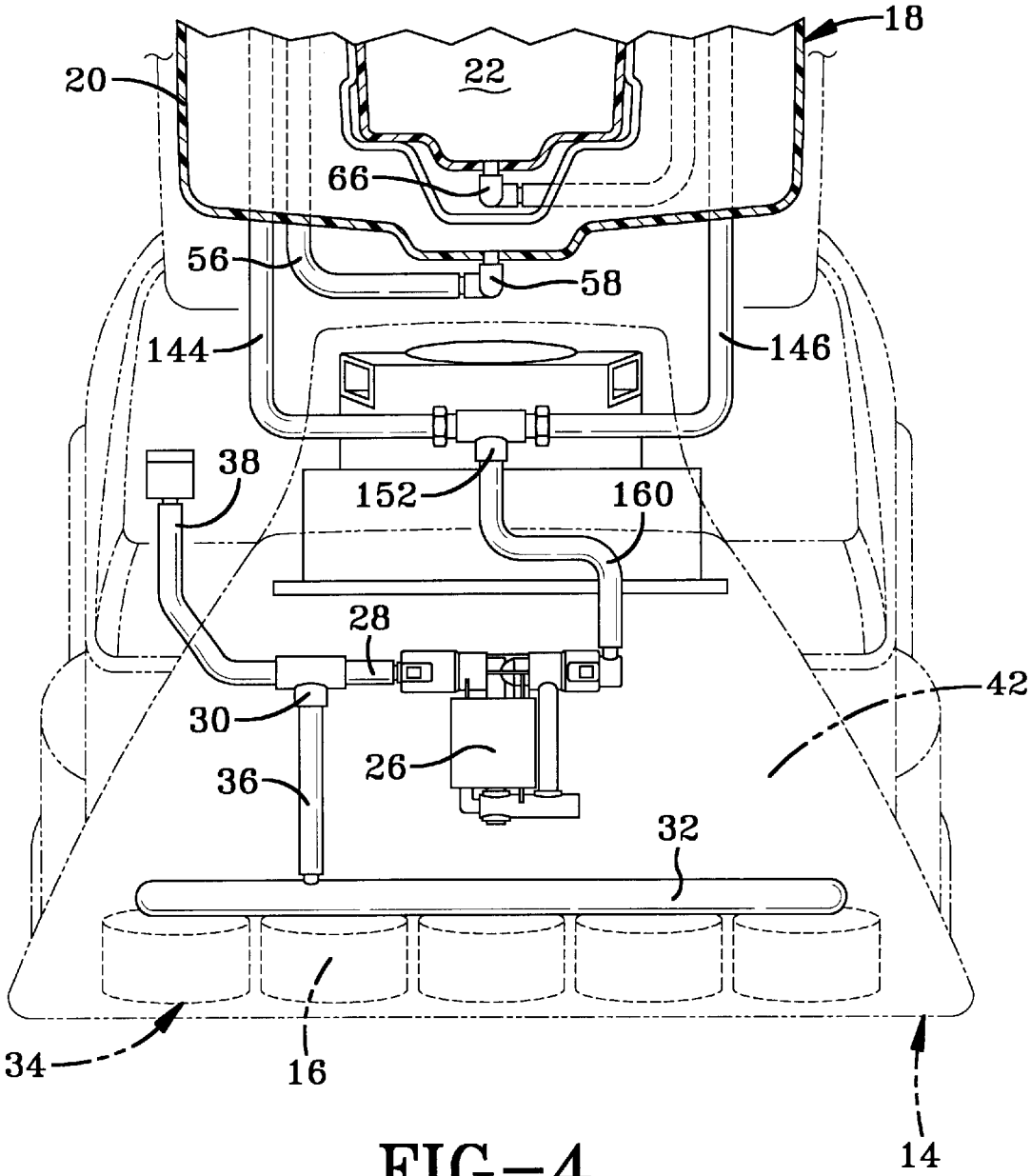
FIG. 4 is an enlarge view of the floor-engaging portion of FIG. 1.

Referring to FIG. 4, the pump 26 conducts the pressurized cleaning solution or clean water through a main supply tube 28 to a control valve 30 which selectively allows the liquid to flow to either a cleaning distributor 32 provided on a brush assembly 34 via a supply tube 36 or a hand-held cleaning attachment (not shown) via a supply tube 38. The cleaning liquid distributor 32 evenly distributes the cleaning liquid to each of the rotary scrub brushes 16. The scrub brushes 16 then spread the cleaning liquid onto the carpet (or bare floor), scrub the cleaning liquid into the carpet and dislodge embedded soil. Such a distributor 32 and scrub brushes 16 are substantially disclosed in commonly owned U.S. Pat. No. 5,867,857, the disclosure of which is hereby incorporated herein as of reference.

As is commonly known, the carpet extractor 10 distributes cleaning solution to the carpeted surface and substantially simultaneously extracts it along with the dirt on the carpet in a continuous operation. In particular, soiled cleaning liquid is extracted from the carpet by a suction nozzle 42, which communicates with a recovery tank 219 (FIG. 10) via an air duct. A vacuum is created in the recovery tank by a motor fan assembly (not shown) that draws air from the recovery tank and exhausts the air to the external atmosphere in a well-known, conventional manner. The recovery tank includes an air and liquid separator (not shown), as is understood by one of skill in the art, for separating liquid from the air entering the recovery tank and recovering the separated liquid in the tank. A suitable upright carpet extractor is disclosed in co-owned U.S. Pat. No. 5,500,977, the disclosure of which is hereby incorporated herein as of reference.

Figure 3:
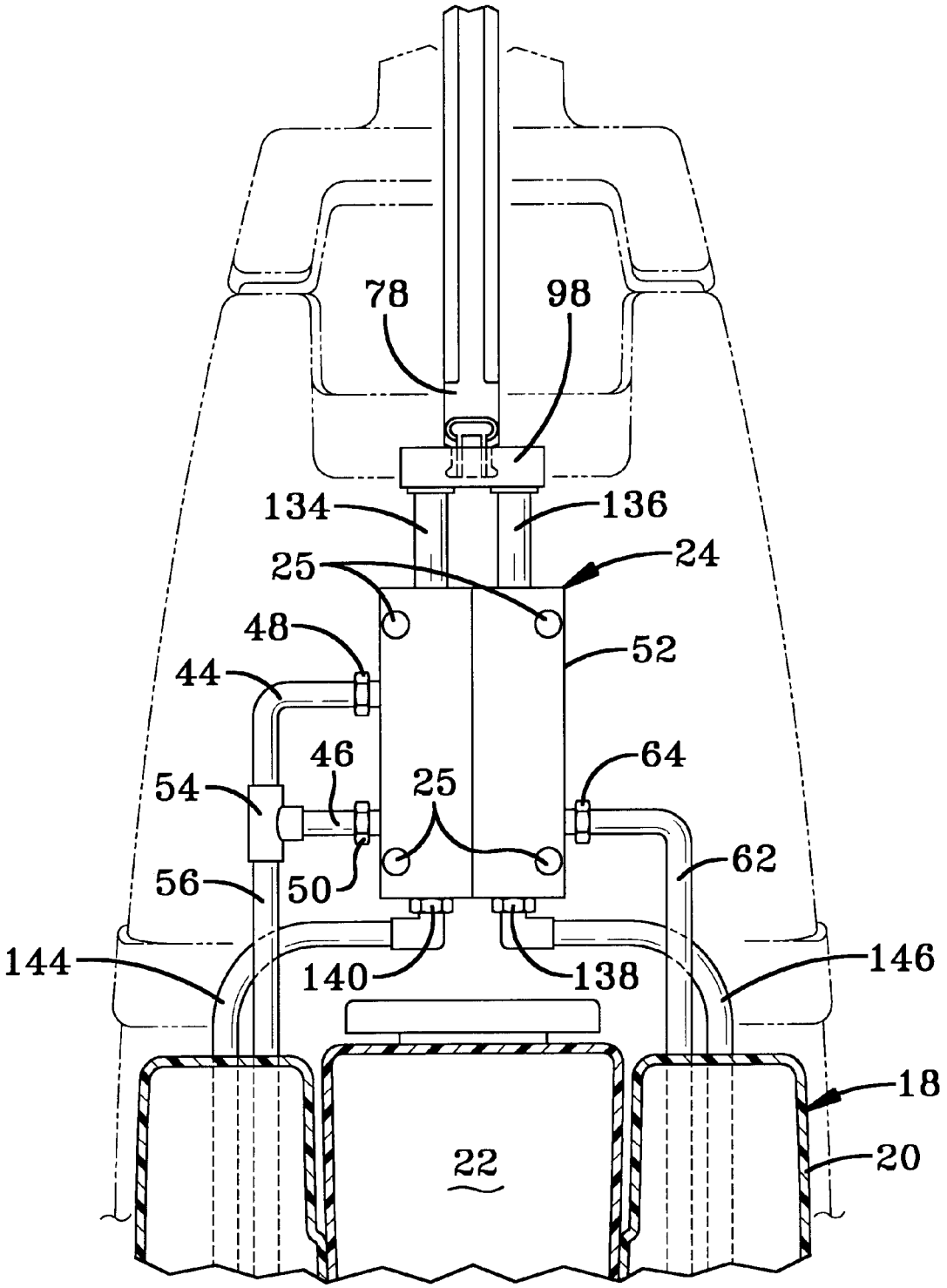
FIG. 3 is an enlarge view of the valve assembly shown in FIG. 1.

Referring to FIG. 3, the clean water supply tank 20 fluidly communicates with the valve assembly 24 via upper and lower water supply tubes 44, 46 connected to respective upper and lower water lateral inlets 48, 50 of a valve body 52 of the valve assembly 24. In particular, the upper and lower supply tubes 44, 46 are fluidly connected to a T-fitting 54, which is fluidly connected to a main water supply tube 56. The main water supply tube 56 is fluidly connected to an outlet 58 (FIG. 1) formed in the bottom of the clean water supply tank 20. The detergent supply tank 22 fluidly communicates with the valve assembly 24 via a detergent supply tube 62. Specifically, one end of the detergent supply tube 62 is connected to a lateral inlet 64 in the valve body 52 and the other end is connected to an outlet 66 (FIG. 1) formed in the bottom of the detergent supply tank 22.

Figure 5:
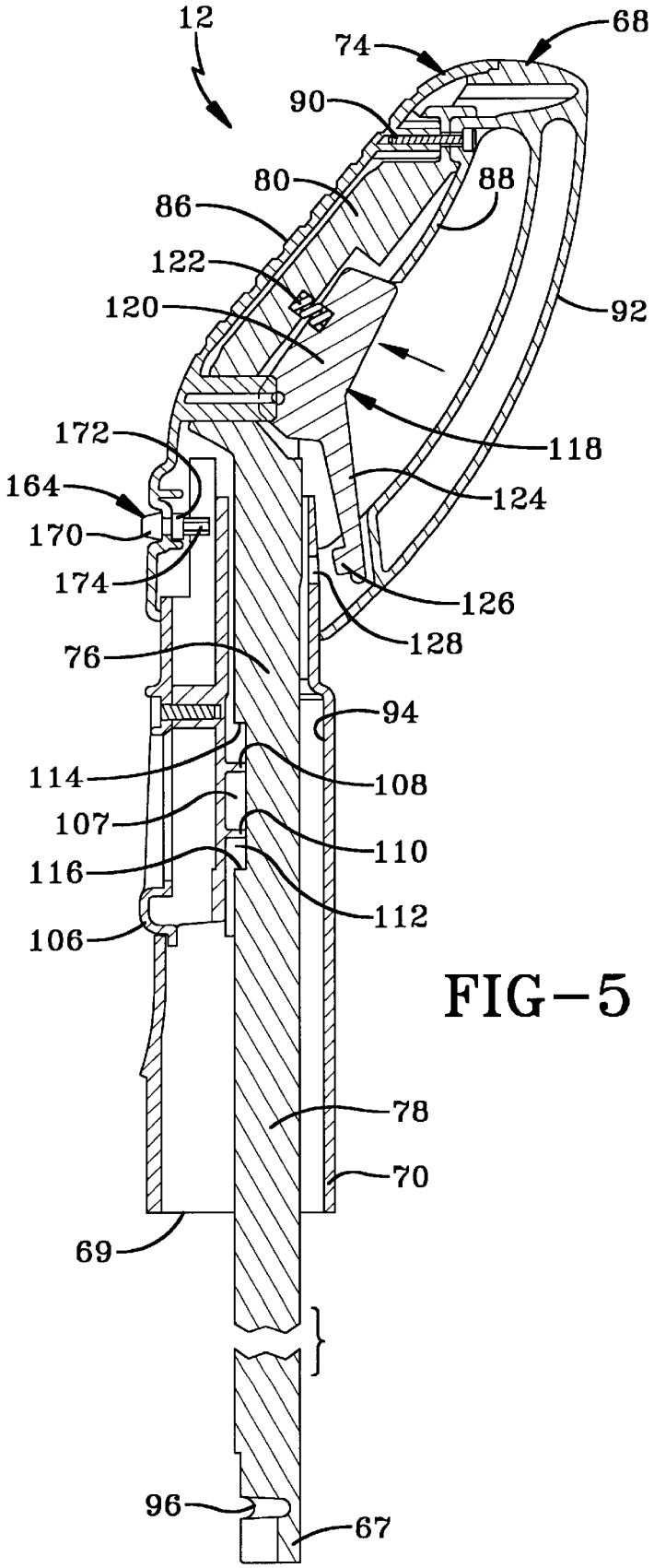
FIG. 5 is a sectional view as taken along line 5—5 in FIG. 1 showing the grip rod being unlock from the handle by the trigger control lever.
Figure 6:
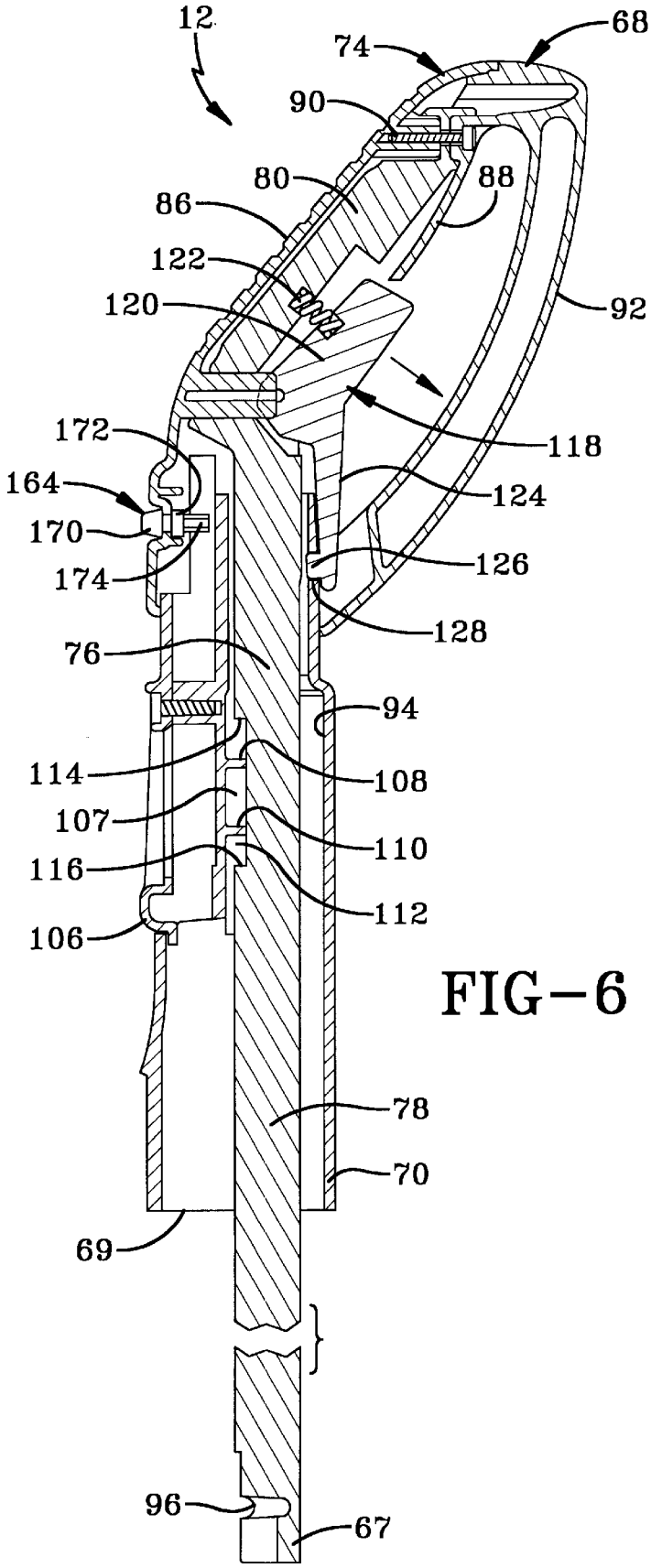
FIG. 6 is a sectional view taken along line 5—5 in FIG. 1 with the grip rod being locked by the trigger control lever.

As shown in FIG. 1, a hand grip 74 is slidably mounted to a handle stem 70 that is fixedly attached to the handle 12 for limited reciprocal motion relative to the handle stem 70 as illustrated by arrow H. As depicted in FIGS. 5 and 6, the upper handle assembly 68 includes the hand grip 74 that is mounted to the top of the handle stem 70 for limited rectilinear reciprocal motion relative to the handle stem 70. The hand grip 74 includes a grip rod 76 having a lower stem portion 78 and an upper grip portion 80 that is located at an angle relative to the lower stem portion 78. A front grip half 86 and a rear grip half 88 are sandwiched about the grip portion 80 of the grip rod 76 and snapped together. A screw 90 is passed through the rear grip half 88, through the grip portion 80 of the grip rod 76, and is threaded into the front grip half 86 to secure the grip halves in place upon the grip portion 80 of the grip rod 76. The hand grip 74 has a lower loop portion 92 integrally formed on the rear grip half 88.

With particular reference to FIG. 1, the handle stem 70 is an upwardly tapering hollow tubular member. A top portion of the handle stem 70 has an inner peripheral surface 94 having a centrally located D-shaped cross section, as best seen in FIG. 4 of U.S. Pat. No. 6,108,862; the disclosure of which is incorporated by reference. The lower stem portion 78 of the grip rod 76 also has a D-shaped cross section that is sized to be slidably received within the handle stem 70 as shown in FIGS. 5 and 6. The hand grip 74 is mounted to the top of handle stem 70 by telescopically sliding the stem portion 78 of the grip rod 76 into the top of the handle stem 70 until a lower end 67 of the grip rod 76 extends below a lower end 69 of the handle stem 70.

With continued reference to FIGS. 5 and 6, a forwardly opening notch 96 is located in the lower end of the grip rod 76, below the lower end 69 of the handle stem 70, for snap connection to an engaging member (not shown) of a base 98 (FIG. 1). The D-shaped cross-section of the stem portion 78 of the grip rod 76 and the inner surface 94 of the top portion of the handle stem 70 prevent the hand grip 74 from twisting or rotating about the longitudinal axis of the stem portion 78 of the grip rod 76 relative to the handle stem 70.

The upper handle assembly 68 further includes a stop pocket 106 mounted to the front of the handle stem 70. A vertically extending ridge 107 having upper and lower portions 108, 110, respectively, extends from a rear or inner surface of the stop pocket 106 and is received In a longitudinally extending recess 112 in the stem portion 78 of the grip rod 76. With this construction, upper and lower portions 108, 110 on the rear of the stop pocket 106 engage respective upper and lower extremities 114, 116 of the recess 112 in the grip rod 76, thereby limiting the upward and downward vertical travel of the grip rod 76 and hand grip 74 relative to the handle stem 70.

Thus, when an operator pulls on the hand grip 74, the hand grip 74 moves up relative to the handle stem 70 into a reverse position in which the upper portion 108 contacts the upper extremity 114 of the recess 112 in the grip rod 76. Alternatively, when an operator pushes on the hand grip 74, the hand grip 74 moves down relative to the handle stem 70 into a forward position in which the lower portion 110 contacts the lower extremity 116 of the recess 112 in the grip rod 76.

With continued reference to FIGS. 5 and 6, a control lever 118 is pivotally connected to the grip portion 80 of the grip rod 76. The control lever 118 includes an upper trigger portion 120 and a lower portion 124. A spring 122, attached to the hand grip 74 and upper portion 120, biases the upper trigger portion 120 outwardly in a counter clockwise direction as indicated by the arrow in FIG. 6. The lower portion 124 includes a protrusion 126 near its lower end, which is urged by the spring 122 into a lateral pilot hole 128 formed in the handle stem 70 as depicted in FIG. 6. When the protrusion 126 is inserted into the pilot hole 128, the hand grip 74 is locked to the handle stem 70 and thus cannot reciprocally move. As shown in FIG. 5, the hand grip 74 is unlocked from the handle stem 70, when a force, as indicated by the arrow, is applied to the trigger portion 120, (for example, by a user grasping the hand grip 74 and squeezing the trigger portion 120 inwardly using his index finger), that overcomes the force of the spring 122, which pivotally moves the lower portion 124 of the control lever 118 away from the handle stem 70 and subsequently the protrusion 126 out of the pilot hole 128.

Figures 7A, 7B, 7C:
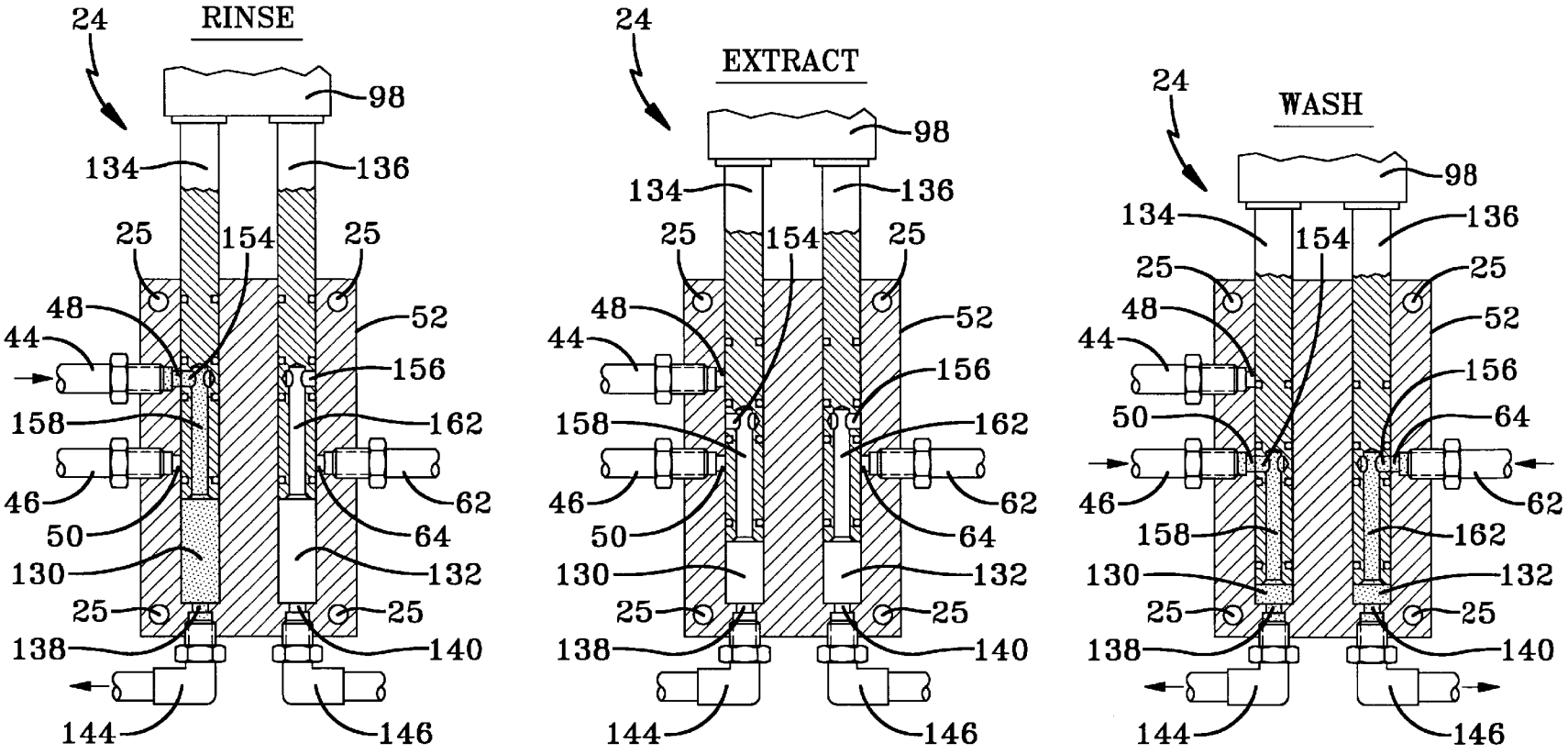
FIG. 7A is a partial, front sectional view of the valve assembly in a position that allows the carpet extractor to operate in the rinse-cleaning mode.
FIG. 7B is a partial, front sectional view of the valve assembly in a position that allows the carpet extractor to operate in the extract only cleaning mode.
FIG. 7C is a partial, front sectional view of the valve assembly in a position that allows the carpet extractor to operate in the wash cleaning mode.

As seen in FIGS. 7A, 7B, and 7C, the valve assembly 24 comprises a valve body 52 having a pair of longitudinal bores 130, 132 for receiving a pair of valve stems 134, 136. The valve stems 134, 136 have respective cylindrically internal passageways 158, 162 formed therein. The valve assembly 24 is mounted to the handleportion 12 (FIG. 1) by bolts 25. A pair of outlets 138, 140 are located on the bottom of the valve body 52 and fluidly communicate with their respective bores 130, 132 and passageways 158, 162 of the valve stems 134, 136. The valve stems 134, 136 are attached to an upper base 98 and extend downwardly therefrom. The base 98 is secured to the lower portion of the grip rod 76 (FIG. 1) by any suitable means. For example, such means could be a nut and bolt connection or the engaging member (not shown) snap connecting into the notch 96 as previously mentioned. Thus, reciprocal movement of the grip rod 76 will in turn cause reciprocal movement of then valve stems 134, 136 inside the bores 130, 132. As depicted in FIG. 1, supply tubes 144, 146 are connected between their respective outlets 138, 140 (FIGS. 7A, 7B, and 7C) and respective branches of a T-fitting 152. As seen in FIG. 4, the T-fitting 152 is fluidly connected to the pump 26 via a main supply tube 160.

As further depicted in FIGS. 7A, 7B, and 7C, the valve stems 134, 136 include lateral inlets 154, 156, respectively, that have similar diameters as the inlets 48, 50, 64 of the valve body 52. The inlets 154, 156 of the valve stems 134, 136 align with their respective inlets 48, 50, and 64 through selective positioning of the valve stems 134, 136 within the bores 130, 132 for desired cleaning modes. In particular, for the rinse-cleaning mode as depicted in FIG. 7A, the inlet 154 in the valve stem 134 aligns with the upper inlet 48 for the clean water but the inlet 156 in the valve stem 136 is not aligned with the inlet 64 of the valve body 52 for the detergent. Thus, clean water can travel through the passageway 158 in the valve stem 134 and bore 130 of the valve body 52 to the outlet 138 of the valve body 52. As shown in FIG. 4, the clean water would then travel to the pump 26 via the supply tube 144, the T-fitting 152, and main supply tube 160 for delivery to the cleaning distributor 32 or cleaning attachment as previously mentioned. For the wash cleaning mode as depicted in FIG. 7C, the inlet 156 of the valve stem 136 aligns with the inlet 64 of the valve body 52 for the detergent and the inlet 154 of the valve stem 134 aligns with the lower inlet 50 of the valve body 52 for the clean water. Thus, liquid detergent can travel through the passageway 162 in the detergent valve stem 136 and bore 132 of the valve body 52 to the outlet 140 of the valve body 52. As depicted in FIG. 4, the liquid detergent would then travel through the supply tube 146 to the T-fitting 152, where the detergent would be combined with the clean water from the supply tube 144. The combined cleaning solution then would travel to the pump 26 via the main supply tube 160 for delivery to the cleaning distributor 32 or cleaning attachment as previously mentioned. For the extract mode as depicted in FIG. 7B, the two inlets 154, 156 are not aligned with any of the inlets 48, 50, 64 of the valve body and thus no clean water and/or detergent can travel to the pump 26. The diameters of the inlets in the valve body and valve stems can be altered for desired amount of liquid flows and flow rates.

Referring to FIGS. 5 and 6, a lockout pin 164 extends through a horizontally extending slot 166 (FIG. 1) passing through the front grip half 86. The inner end 174 of the lockout pin 164 is received in a "S-shaped" recess 168 (FIG. 2) in the front surface of the handle stem 70. The lockout pin 164 includes a head portion 170 and base portion 172 that sandwich portions of the front grip half 86 located on opposite sides of the slot 166 (FIG. 1) to allow the lockout pin 164 to slide longitudinally along the slot 166 (FIG. 1) while being secured to the front grip half 86.

Figure 2:
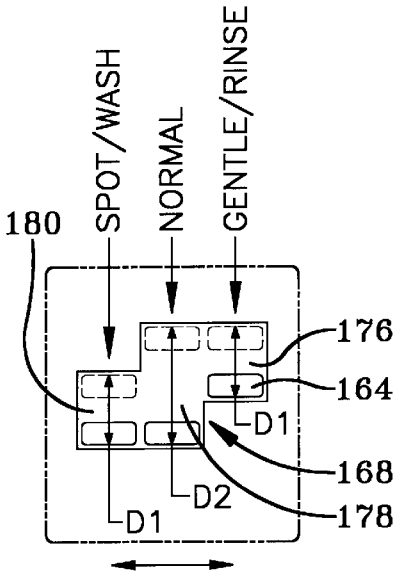
FIG. 2 is an enlarged view of the portion circled in FIG. 1 with the front handgrip removed.

As depicted in FIG. 2, the "S-shaped" recess 168 includes an upper portion 176, a middle portion 178, and a lower portion 180 for the lockout pin 164 to be selectively positioned therein, through horizontal movement of it as indicated by the horizontal arrows. The position of the lockout pin 164 in one of the upper portion 176, middle portion 178, and lower portion 180 correspond to respective gentle, normal, or spot wash cleaning cycles as indicated in FIG. 2. In particular, when the lockout pin 164 is positioned in the upper portion 176, the hand grip 74 can only move between the boundaries of the upper portion 176 of the recess 168 as indicated by the D1. Correspondingly, this limits the valve stems 134, 136 to be positioned in only the extract mode and rinse mode. When the lockout pin 164 is positioned in the lower portion 180, the hand grip 74 can only move between the boundaries of the lower portion 180 of the recess 168 as indicated by D3. Correspondingly, this limits the valve stems 134, 136 to be positioned in only the extract mode and wash mode. Finally, when the user positions the lockout pin 164 to be in the middle portion 178, the hand grip 74 can fully move up and down relative to the handle stem 70 and thus allow the valve stems 134, 136 to be positioned in the rinse, extract, or wash modes.

In operation, with the lockout pin 164 positioned in the normal cycle (D2 of FIG. 2), a user grasps the hand grip 74 of the carpet extractor 10 and squeezes the trigger portion 120 with the index finger to unlock the grip rod 76 from the handle stem 70 as shown in FIG. 5. The user then pushes downwardly and forwardly on the hand grip 74 which moves the extractor 10 with the floor engaging portion 14 in the forward direction and also moves the grip rod 76 down relative to the handle stem 70, thereby positioning the valve stems 134, 136 in the wash cleaning mode (FIG. 7C). Thus, cleaning solution is distributed to the carpet or bare floor as previously mentioned. After completing this forward stroke, the user then pulls on the hand grip 74 moving the extractor 10 in the rearward direction and also moving the grip rod 76 up relative to the handle stem 70 thereby positioning the valve stems 134, 136 in the rinse cleaning mode (FIG. 7A). Thus, clean water is distributed to the carpet or bare floor as previously mentioned.

After completing this reverse stroke, the user then releases the trigger portion 120 and moves the hand grip 74 so that the protrusion 126 engages the pilot hole 128 thereby locking the hand grip 74 and grip rod 76 to the handle stem 70 as shown in FIG. 6. This causes the valve stems 134, 136 to be positioned in the extract cleaning mode (FIG. 7B). The user then pushes the extractor 10 in the forward direction to only extract soiled solution from the carpet or bare floor. If desired after the forward extracting stroke, the user can pull on the extractor 10 to extract the soiled solution from the carpet again. Also, the sequence of the cleaning modes can be altered to come up with multiple cleaning cycles. For example, a user may want to extract first, then wash, rinse and extract, or wash first, then extract on both the reverse and forward strokes, then rinse and extract. It should be noted that the control lever 118 could be removed and the hand grip 74 could be secured on the handle stem 70 at a location that positions the valve stems 134, 136 in the extract mode by constructing and arranging the hand grip 74 and handle stem 70 so that the frictional forces between them overcome the weight of the hand grip 74, yet will allow the hand grip 74 to reciprocally move from the extra force applied by a user.

Figure 8:
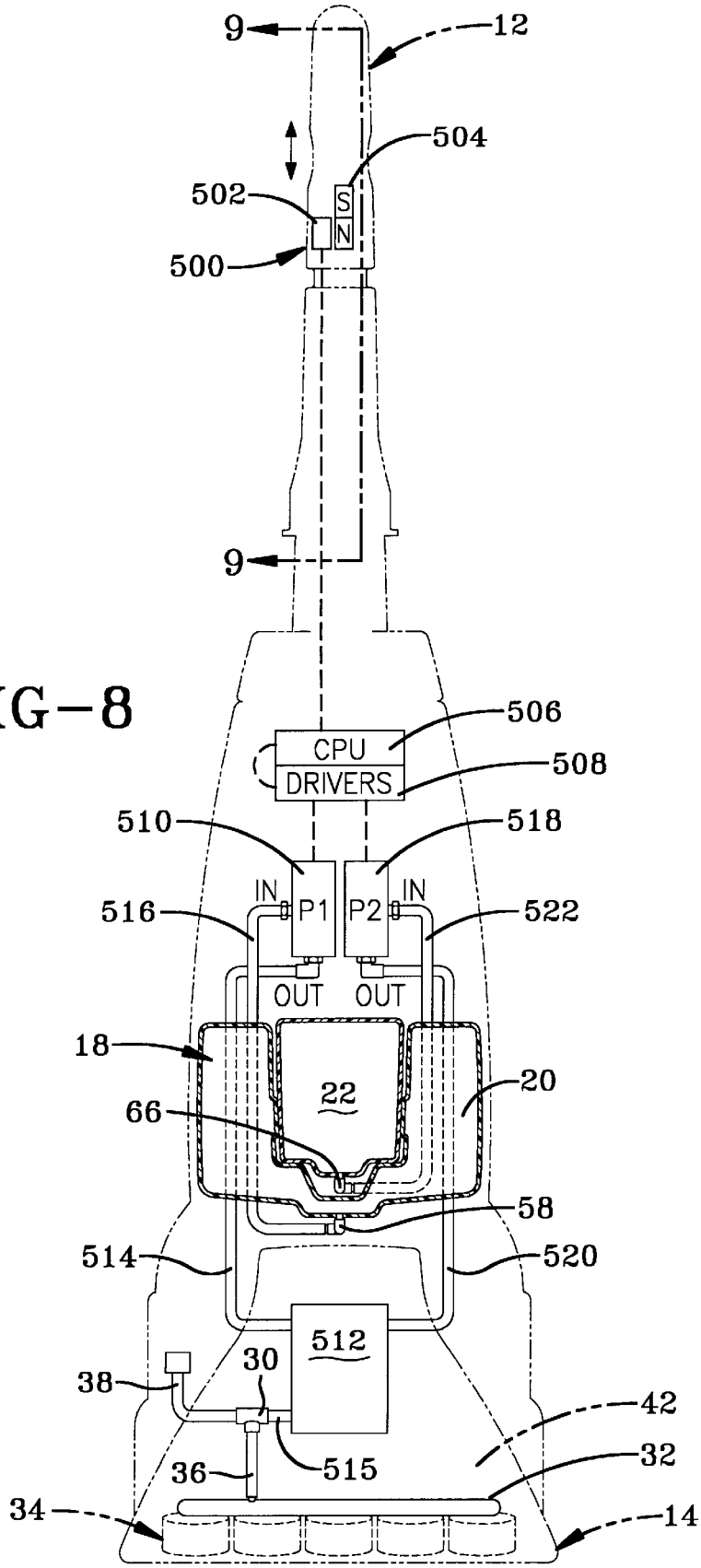
FIG. 8 is a diagrammatic partial, front sectional view of a carpet extractor incorporating a fluid distribution system of another embodiment according to the present invention.
Figure 9:
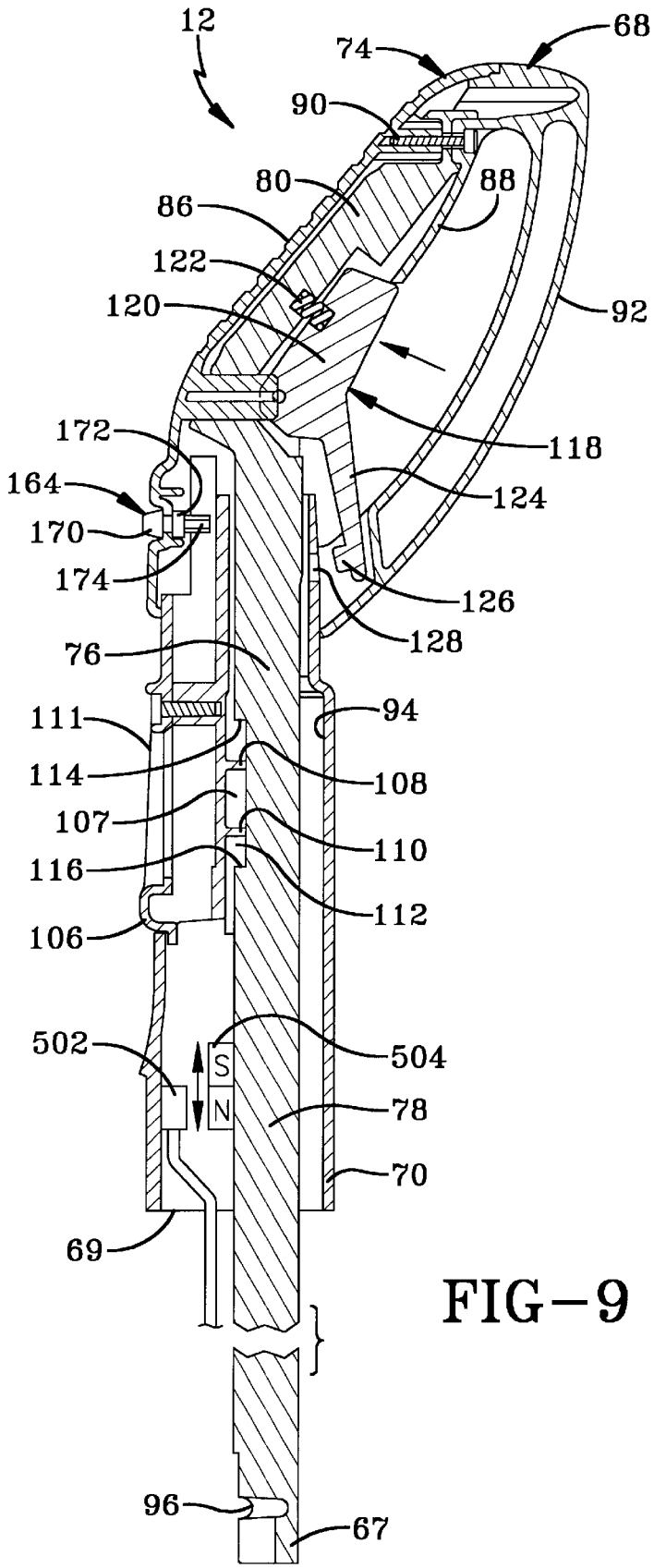
FIG. 9 is a sectional view as taken along line 9—9 in FIG. 8 showing the grip rod being unlock from the handle by the trigger control lever.

FIGS. 8 and 9 depict another embodiment of the present invention. In these figures, components from the embodiment shown in FIGS. 1 through 5 and 7A, 7B, and 7C, which are identical in structure and have identical functions will be identified by the same reference numbers. In this embodiment, a detecting unit 500 comprising a hall sensor 502 and magnet 504 is secured to the handle portion 12. As best seen in FIG. 9, the hall sensor 502 is secured to the inner surface 94 of the handle stem 70 across from the magnet 504, which is secured to the grip rod 76. The magnet 504 reciprocally moves up and down such that the hall sensor positions between the north (N) and south (S) poles of the magnet 504 during the movement as depicted by the arrows in response to similar reciprocal movement by the grip rod 76 and hand grip 74.

Referring to FIG. 8, the hall sensor 502 is electrically connected to a microprocessor (CPU) 506 and drive unit 508. A pump unit 510 for the clean water supply tank 20 is operatively connected to the drive unit 508, and fluidly connected to a mixing container 512 via a supply tube 514 and the clean water supply tank 20 via supply tube 516. A pump unit 518 for the detergent tank 22 is operatively connected to the drive unit 508, and fluidly connected to the mixing container 512 via a supply tube 520 and detergent tank 22 via supply tube 522. The mixing container 512 is fluidly connected to the valve 30 via the main supply tube 515. The microprocessor 506 is programmed to operate in the various cleaning modes depending on the entry and sequence (number of times) of entry into the proximity of the magnetic field of the north pole of the magnet 504 by the hall sensor 502 which will be explained in more detail.

In operation, with the lockout pin 164 positioned in the normal cycle (D2 of FIG. 2), a user grasps the hand grip 74 of the carpet extractor 10 and squeezes the trigger portion 120 with the index finger to unlock the grip rod 76 from the handle stem 70 as shown in FIG. 9. The user then pushes downwardly and forwardly on the hand grip 74 moving the magnet 504 to position the hall sensor 502 into the magnetic field of the north pole position of the magnet 504 and also moving the extractor 10 with the floor engaging portion 14 in the forward direction. At this position, the hall sensor 502 breaks into the positive gauss of the magnetic field of the north pole thereby causing the hall sensor 502 to output a high control signal to the microprocessor 506. Upon receipt of the signal, the microprocessor 506 activates the drive unit 508 to be in the wash mode which activates the pump 510 to draw water from the clean water supply tank 20 to the mixing container 512 and also activates the detergent pump 518 to draw detergent liquid from the detergent supply tank 22 to the mixing container 512. The combine solution then travels by gravity through the main supply tube 515 to the control valve 30, which selectively allows the liquid to flow to either the cleaning distributor, 32 provided on a brush assembly 34 via a supply tube 36 or a hand-held cleaning attachment (not shown) via a supply tube 38.

After completing the forward stroke, the user then pulls upwardly and rearwardly on the hand grip 74 moving the magnet 504 to position the hall sensor 502 away from the proximity of the magnetic field of the north pole position of the magnet 504, and also moving the extractor 10 with the floor-engaging portion 14 in the rearward direction. When the hall sensor 502 is out of the proximity of the magnetic field of the north pole, the hall sensor 502 outputs a low control signal to the microprocessor 506. Upon receipt of the low control signal, the microprocessor 506 activates the drive unit 508 to be in the rinse mode which deactivates the pump 518 for the detergent supply tank 22 yet maintains activation of the pump 510 to draw clean water from the clean water supply tank 20 to the mixing container 512. The clean water then travels by gravity through the main supply tube 515 to the control valve 30, which selectively allows the clean water to flow to either the cleaning distributor 32 provided on a brush assembly 34 via a supply tube 36 or a hand-held cleaning attachment (not shown) via a supply tube 38.

After completing the reverse stroke, the user then pushes downwardly and forwardly on the hand grip 74 again moving the magnet 504 to position the hall sensor 502 in the magnetic field of the north pole of the magnet 504 and also moving the extractor 10 with the floor-engaging portion 14 in the forward direction. As previously mentioned, the hall sensor 502 outputs a high control signal to the microprocessor 506. However, with the hall sensor 502 being in the magnetic field for the second time, the microprocessor 506 is programmed to activate the drive unit 508 to be in the extract mode which deactivates both pumps 510, 518 thereby allowing no liquid to flow into the mixing container 512 and subsequently to the cleaning surface. For the subsequent forward stroke, the microprocessor 506 is programmed to activate the drive unit 508 to also be in the extract mode upon receipt of the low control signal from the hall sensor 502, when it no longer is in the proximity of the magnetic field of the north pole for the second time.

It should be noted that the microprocessor 506 can be programmed to change the sequence of cleaning modes as desired by the user. In this manner, a touch screen 111 is mounted across the outer recess of the stop pocket 106 and electrically communicates with the microprocessor by remote control. A user touches the touch screen 111 which sends or transmits a signal to the microprocessor 506 which is programmed to cause the extractor 10 to operate in the previously mentioned normal, gentle, or spot cleaning cycles in response to the number of times the user touched the screen 111, after the extractor is turned on. It should be noted that the cleaning cycle can be user defined as well. The touch screen 111 could have various operating mode and user information displayed in the form of alphanumeric and graphic light crystal displays (LCD's). Alternatively, other indicating devices such as light emitting diodes (LED) could be use to indicate such user feedback information.

Also, other detecting units can be substituted for the hall sensor 502 and magnet 504. For example, a sequencer, a mechanical switch or an optical switch could be used as the detecting unit. Further, other user input devices could be substituted or used in conjunction with the touch screen 111 to select the cleaning mode. For example, such devices could be a tactile membrane switch or a push button.

Figure 10:
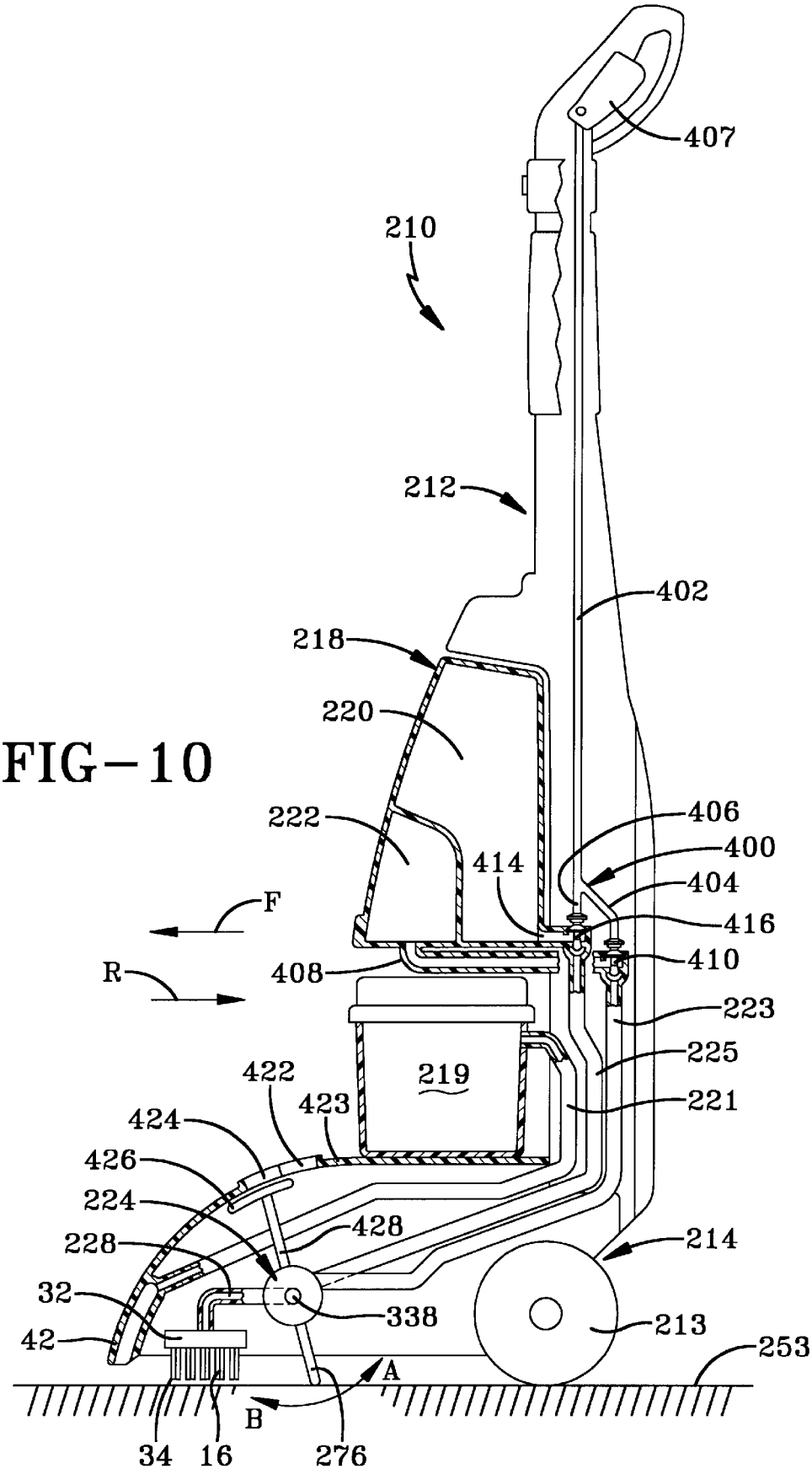
FIG. 10 is a diagrammatic partial, side sectional view of a carpet extractor incorporating a fluid distribution system according to still another embodiment of the present invention.

FIGS. 10 through 15 show still another embodiment of the invention. In these figures, components from the embodiment shown in FIGS. 1 through 5 and 7A, 7B, and 7C, which are identical in structure and have identical functions will be identified by the same reference numbers. Referring to FIG. 10, the upright carpet extractor 210 includes a pivotal handle portion 212 for propelling a floor-engaging portion or foot 214 with wheels 213 over a cleaning surface 253. The floor-engaging portion 214 preferably includes a plurality of rotating scrub brushes 16 for scrubbing the cleaning surface or carpet 253 (or bare floor). A supply tank assembly 218 is removably mounted to the handle portion 212 of the extractor. The supply tank assembly 218 comprises a clean water supply tank 220 and a detergent supply tank 222 adjacent to the clean water supply tank 220.

A push rod assembly 400 comprising an upper portion 402 and a pair of lower legs 404, 406 integrally formed with the upper portion 402. The upper portion 402 extends upwardly through the handle portion and Is pivotally connected at its upper end to a trigger switch 407, which is pivotally connected to the handle portion 212 and urged upwardly by a pair of cantilever springs (not shown). One leg 404 extends downwardly to a reservoir 408, which is fluidly connected to the detergent tank 222, and bears against a release valve 410 positioned over an opening in the reservoir 408. The other leg 406 of the push rod assembly 400 extends downwardly to a reservoir 414, which is fluidly connected to the clean water supply tank 220, and bears against a release valve 416 positioned over an opening in the reservoir 414. This release valve 416 is similar to that of the detergent tank 222. The release valves 410, 416 are opened through downward movement of the legs 404, 406 pressing against them. Further details of such a water release valve, reservoir, and trigger are disclosed in co-owned U.S. Pat. Nos. 5,500,977 and 6,247202 the disclosures of which are hereby incorporated herein as of reference. Upon an operator squeezing the trigger 407 upwardly, this causes the trigger 407 to rotate counter clockwise resulting in downward movement of the push md assembly 400, thereby opening the release valves 410, 416 causing gravitational flow of clean water and detergent from their respective reservoirs 414, 408.

The clean water and detergent flow by gravity from their respective tanks 220, 222 to respective inlets (FIG. 11) of a valve assembly 224 via respective supply tubes 225, 223. The valve assembly 224 is mounted to the floor-engaging portion 214. The cleaning liquid comprising the detergent and/or clean water from the valve assembly 224 travels through a main supply tube 228 to a cleaning distributor 32 provided on a brush assembly 34. The cleaning liquid distributor 32 evenly distributes the cleaning liquid to each of the rotary scrub brushes 16. The scrub brushes 16 then spread the cleaning liquid onto the carpet 253 (or bare floor), scrub the cleaning liquid into the carpet, and dislodge embedded soil. Such a distributor 32 and scrub brushes 16 are substantially disclosed in commonly owned U.S. Pat. No. 5,867,857, the disclosure of which is hereby incorporated herein as of reference.

As is commonly known, the carpet extractor 210 distributes cleaning solution to the carpeted cleaning surface 253 and substantially simultaneously extracts it along with the dirt on the carpet 253 in a continuous operation. In particular, soiled cleaning liquid is extracted from the carpet 253 by a suction nozzle 42, which communicates with a recovery tank 219 via an air duct 221. A vacuum is created in the recovery tank 219 by a motor fan assembly (not shown) that draws air from the recovery tank 219 and exhausts the air to the external atmosphere in a well-known, conventional manner. The recovery tank 219 includes an air and liquid separator (not shown), as is understood by one of skill in the art, for separating liquid from the air entering the recovery tank 219 and recovering the separated liquid in the tank 219. A suitable upright carpet extractor is disclosed in co-owned U.S. Pat. No. 5,500,977, the disclosure of which is hereby incorporated herein as of reference.

Figures 11, 12, 13:
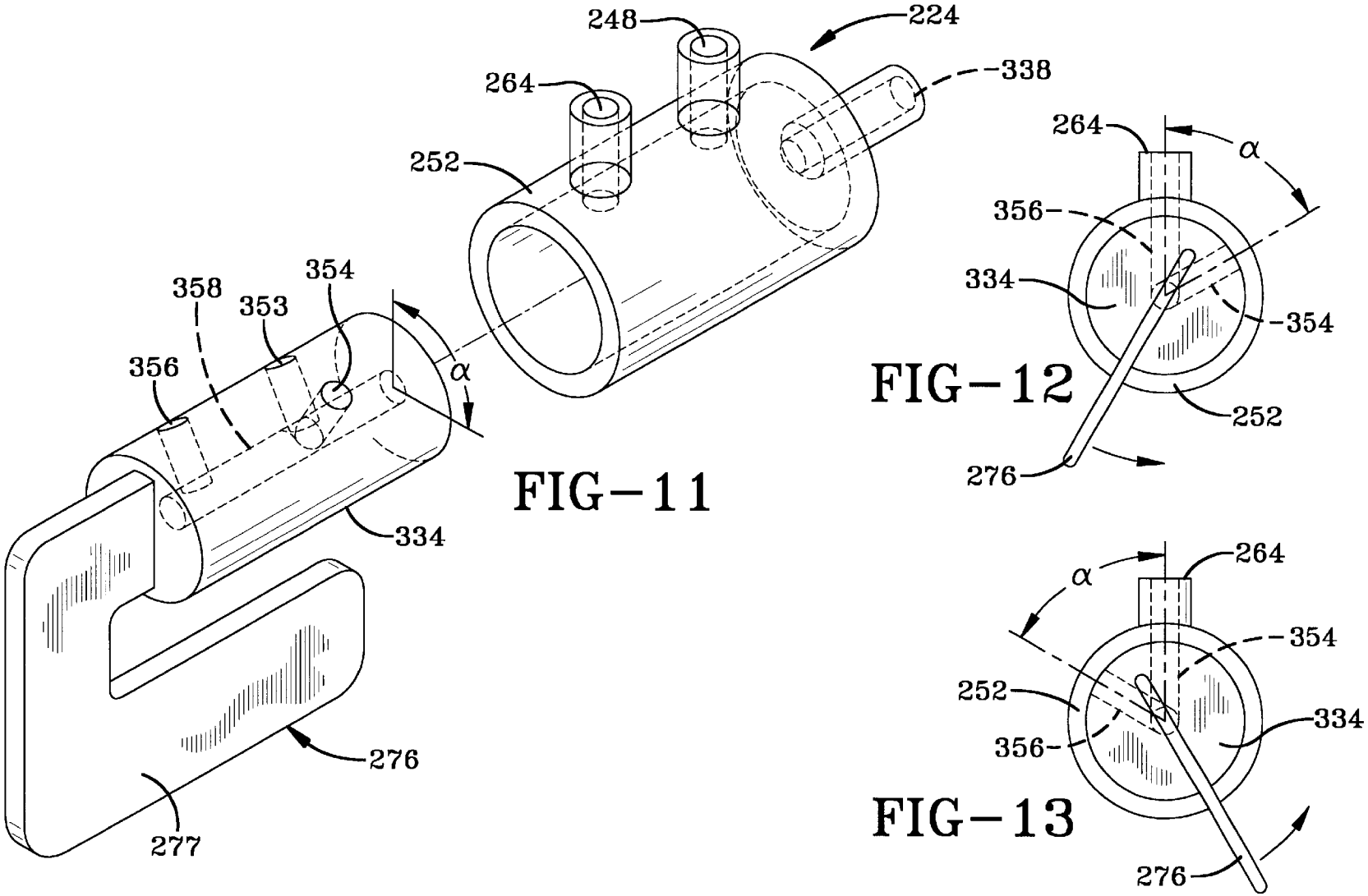
FIG. 11 is an exploded view of the valve assembly with the tongue of the embodiment of FIG. 10.
FIG. 12 is a left side view of FIG. 11 with the valve assembly assembled and positioned in the wash cleaning mode.
FIG. 13 is a left side view of FIG. 11 with the valve assembly assembled and positioned in the rinse-cleaning mode.
Figure 14:
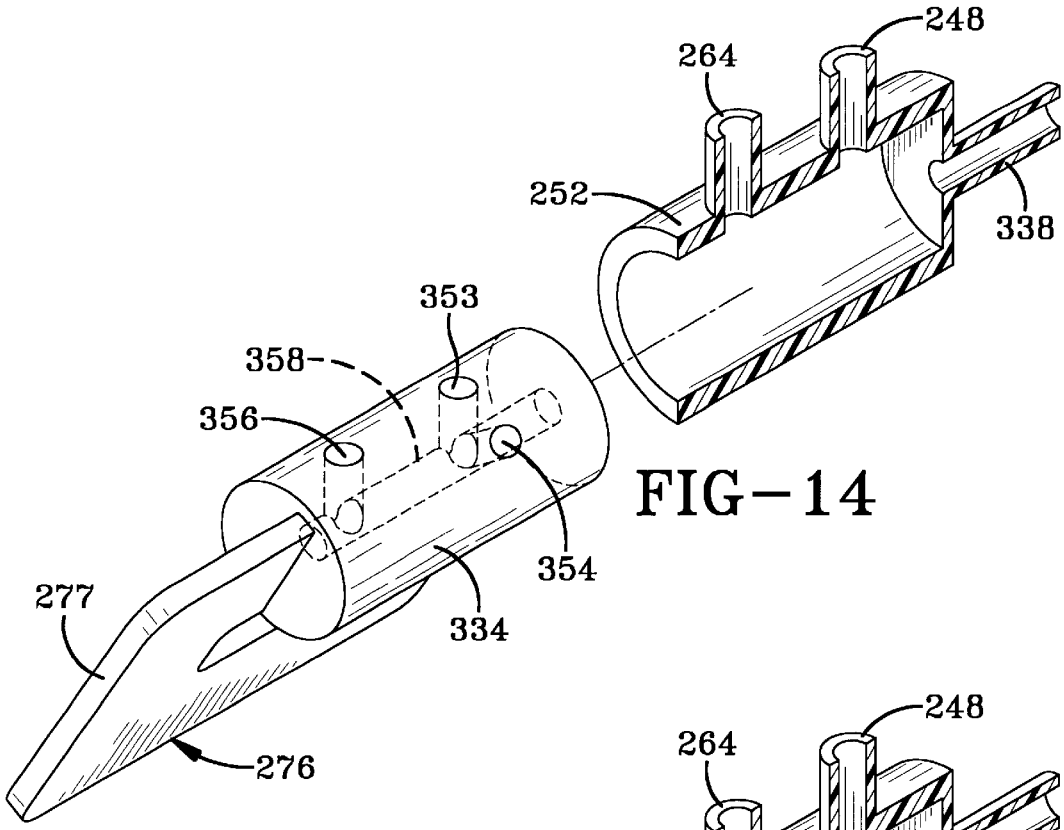
FIG. 14 is an exploded view of the valve assembly with the tongue of the embodiment of FIG. 10 in the wash cleaning mode.
Figure 15:
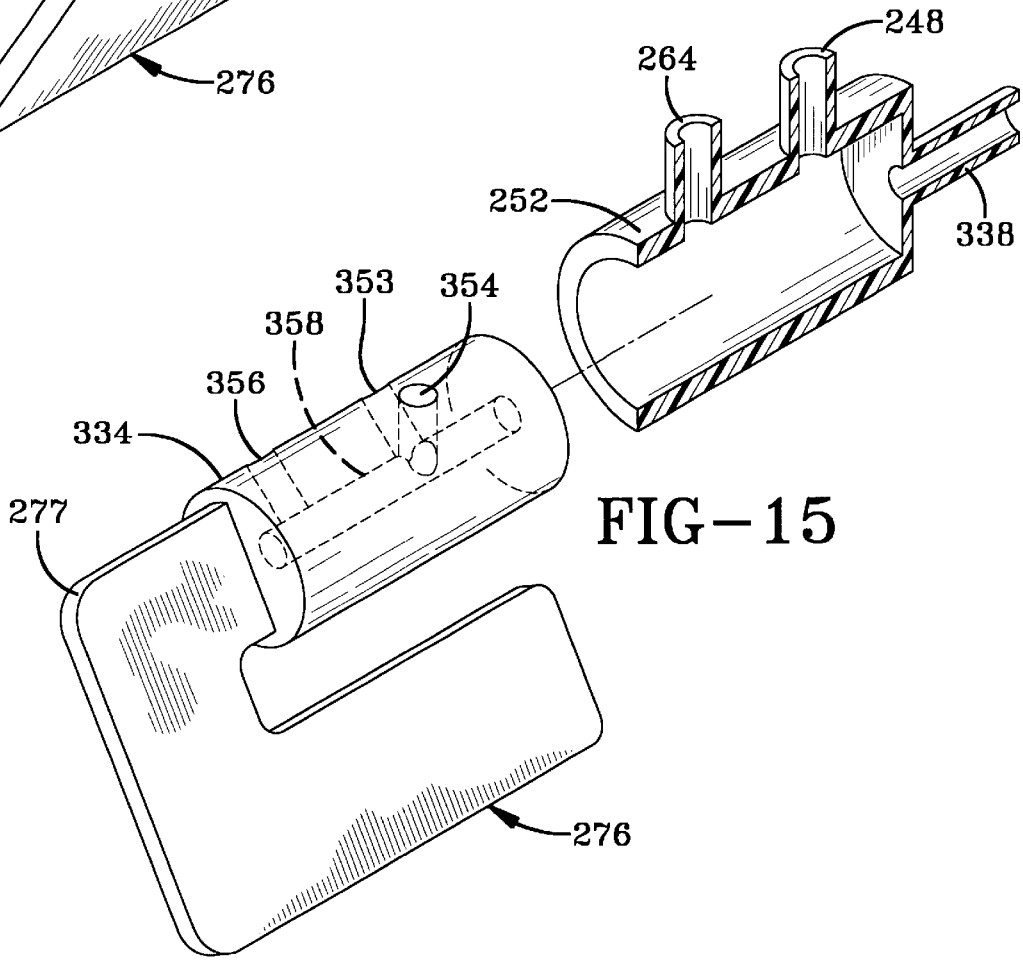
FIG. 15 is an exploded view of the valve assembly with the tongue of the embodiment of FIG. 10 in the rinse-cleaning mode.

As seen in FIGS. 11, 14, and 15, the valve assembly 224 includes a hollow cylindrical shell or body 252 for receiving a hollow cylindrical valve stem 334. The stem 334 extends laterally and has a cylindrical internal passage 358 fluidly communicating with an outlet 338 in the valve shell 252, which fluidly connects with the main supply tube 228. The valve shell 252 has an inlet 264 for the detergent supply tube 223 and an inlet 248 for the clean water supply tube 225. The stem 334 has a pair of inlets 353, 354 which selectively align with the inlet 248 of the valve shell 252 for the clean water and an inlet 356, which selectively aligns with the inlet 264 of the valve shell 252 for the detergent solution, which will be explained in more detail. The inlets 248, 264 of the valve shell have similar diameters as the inlets 353, 354, and 356 of the valve stem 334. A flexible J-shaped tongue 276 is connected at the end of the valve stem 334 opposite the outlet 338 of the shell 252. The tongue 276 includes a leg portion 277 that is parallel with the longitudinal axis of the valve stem 334 and extends along the length of the valve stem 334.

Referring to FIG. 10, the tongue 276 contacts the cleaning surface 253 at the leg portion 277. The tongue 276 moves to position A when the floor engaging portion 214 of the extractor 210 moves in the forward (F) direction, and moves to position B when the floor engaging portion 214 of the extractor 210 moves in the rearward direction (R). The rotating movement of the tongue 276 between positions A and B will in turn cause rotating movement of the valve stem 334 within the valve shell 252 to respective wash and rinse cleaning modes, which will be explained further in more detail. The tongue 276 is composed of a flexible material such that it will bend or deform slightly as it rotates and contacts the cleaning surface 253 so that it will not cause the floor-engaging portion 214 to rise. Alternatively, the tongue 276 may just have a flexible end at the leg portion 277 to perform this function.

The inlets 248, 264 of the valve shell 252 align with inlets 353, 354, and 356 of the valve stem 334 through selective rotating positioning of the valve stem 334 with respect to the valve shell 252 for desired cleaning modes. In particular, for the rinse-cleaning mode as depicted in FIG. 15, the inlet 354 in the stem 334 aligns with the inlet 248 in the valve shell 252 for the clean water. However, as also shown in FIG. 13, the inlet 356 in the stem 334 is not aligned with the inlet 264 of the valve shell 252 for the detergent. Thus, clean water can travel through the chamber or passageway 358 in the valve stem 334 to the outlet 338 of the valve shell 252. As shown in FIG. 10, the water would then travel to the cleaning distributor 32 via the main supply tube 228 as previously mentioned.

For the wash cleaning mode as depicted in FIG. 14, the inlet 356 in the stem 334 aligns with the inlet 264 of the valve shell 252 (also seen in FIG. 12) for the detergent and the inlet 353 in the stem 334 aligns with the inlet 248 of the valve shell 252 for the clean water. Thus, the liquid detergent and clean water can flow to the passageway 358 of the valve stem 334 where they are mixed and the combined cleaning solution travels to the outlet 338 of the valve shell 252. As depicted in FIG. 10, the combined cleaning solution would then travel through the main supply tube 228 to the cleaning distributor 32 as previously mentioned. A locking assembly could also be employed to allow the valve stem 334 to be selectively position in only the rinse mode or wash mode. Alternatively, a coupling member (not shown) could be pivotally connected between the tongue 276 and one of the wheels 430 so that the tongue 276 could rotate in response to movement of the wheels 213 upon the floor engaging portion 214 being moved between the forward and rearward direction.

With reference to FIG. 10, a rinse mode window 422 and a wash mode window 424 is preferably located on the hood portion 423 of the floor-engaging portion 214 above the valve assembly 224. Visible through the windows is a brightly colored plate 426 attached to an arm 428 which is attached to the tongue 276 to indicate the cleaning mode of the extractor 210 with respect to the rotational position of the valve stem 334 in each mode. In particular, when the valve stem 334 is rotated to the rinse mode, this movement causes the plate 426 to be positioned to be visible in the rinse mode window 422. When the valve stem 334 is rotated to the wash mode, this movement causes the plate 426 to be positioned to be visible in the wash mode window 424.

In operation, the operator grasps the handle portion 212 and squeezes the trigger 407 to open the release valves 410, 416. The operator pushes the extractor 210 in the forward direction (F) thereby rotating the tongue 276 to position A and positioning the valve stem 334 in the wash cleaning mode (FIGS. 12 and 14). Thus, cleaning solution is distributed to the carpet or bare floor as previously mentioned. After completing this forward stroke, the operator then pulls the extractor 210 in the rearward direction (R) thereby rotating the tongue 276 to position B and positioning the valve stem 334 in the rinse-cleaning mode (FIGS. 13 and 15). Thus, clean water is distributed to the cleaning surface 253 as previously mentioned. It should be noted that the invention could alternatively operate without a trigger, a push rod assembly, and release valves. In this respect, the clean water and detergent would flow through their respective supply tubes 225, 223 down to the valve assembly 224 where they would be selectively allowed to flow as previously mentioned. The operator could position the floor-engaging portion 214 so that the tongue 276 is centrally located between A and B, thereby positioning the valve stem 334 with respect to the valve shell 252 so that none of the inlets 353, 354, and 356 in the valve stem 334 are aligned with the inlets 248, 264 in the valve shell 252 to allow any fluid communication between them.

By incorporating a rinse application as shown in the embodiments, a higher concentration of detergent in the cleaning fluid, generally two or more times as much as the clean water, can be used to wash the carpet during the first forward stroke, since the rinse application will rinse or remove the detergent residue not extracted. In particular, the carpet extractor will distribute the cleaning solution having the high detergent concentration on the forward stroke as it substantially and simultaneously extracts it along with the dirt on the carpet in a continuous operation. Then, the carpet extractor will distribute the cleaning solution having the clean water on the reverse stroke to rinse the detergent residue not extracted as the carpet extractor substantially and simultaneously extracts it along with the dirt on the carpet in a continuous operation. Thus, cleaning performance is improved.

The present invention has been described by way of example using the illustrated embodiments. Upon reviewing the detailed description and the appended drawings, various modifications and variations of the embodiments will become apparent to one of ordinary skill in the art. All such obvious modifications and variations are intended to be included in the scope of the present invention and of the claims appended hereto. For example, clean water could be applied on the forward stroke and detergent solution on the reverse stroke. Also, a certain liquid might be added to the clean water or be used alone to improve the rinsing operation.

In view of the above, it is intended that the present invention not be limited by the preceding disclosure of the embodiments, but rather be limited only by the appended claims.

What is claimed is:

1. A cleaning apparatus for cleaning a surface in which cleaning solution is dispensed to the surface and substantially simultaneously extracted along with the dirt on the surface in a continuous operation comprising:

a) a floor-engaging portion for moving along said surface;

b) a distributor;

c) a first source for supplying a first liquid to said distributor, said distributor being operatively connected to said floor-engaging portion for distributing said first liquid from said first source onto said surface;

d) an activating device operatively connected to said first source to activate said first source to supply said first liquid to said distributor to distribute said first liquid onto said surface in response to said floor-engaging portion being moved in a first direction;

e) a handle pivotally connected to said floor-engaging portion;

f) said activating device including a hand grip reciprocally mounted on said handle; and g) said hand grip being moved a distance along said handle in said first direction to activate said first source to supply said first liquid to said distributor in response to said floor-engaging portion being moved in said first direction.

2. The cleaning apparatus according to claim 1 wherein said activating device includes a grip rod connected to said hand grip and extending down from said hand grip, a valve assembly operatively connected to said grip rod, said first source, and said distributor, wherein said hand grip being moved said distance along said handle in said first direction thereby moving said grip rod to cause said valve assembly to open and activate said source to allow said first source to supply liquid to said distributor.

3. The cleaning apparatus according to claim 2 including a second source for supplying a second liquid to said distributor, said valve assembly being operatively connected to said second source, wherein said hand grip being moved a distance along said handle in said second direction opposite said first direction thereby moving said floor-engaging portion in said second direction, and moving said grip rod to cause said valve assembly to fluidly connect said second source to said distributor allowing said second source to supply said second liquid to said distributor to distribute said second liquid onto said surface.

4. The cleaning apparatus according to claim 3, wherein said valve assembly comprises:

a) a valve body having a first bore and a second bore formed therein, said valve body having a first inlet fluidly connected to said first source and said first bore, said valve body having a second inlet fluidly connected to said second source and said second bore;

b) a first valve stem being operatively connected to said grip rod and being slidably received in said first bore, said first valve stem fluidly communicating with said distributor, said first valve stem having an inlet formed therein;

c) a second valve stem being operatively connected to said grip rod and being sildably received in said second bore, said second valve stem fluidly communicating with said distributor, said second valve stem having an inlet formed therein; and d) wherein said hand grip being moved said distance along said handle in said first direction thereby moving said grip rod to move said first valve stem to align said inlet of said first valve stem with said first inlet of said valve body thereby activating and allowing said first source to supply said first liquid to said distributor, said hand grip being moved said distance along said handle in said second direction thereby moving said grip rod to cause said valve assembly to fluidly connect said second source to said distributor allowing said second source to supply said second liquid to said distributor.

5. The cleaning apparatus according to claim 1 including a second source for supplying a second liquid to said distributor, wherein said hand grip being moved a distance along said handle in a second direction opposite said first direction to activate said second source to supply said second liquid to said distributor to distribute said second liquid on said surface in response to said floor-engaging portion being moved in said second direction.

6. The cleaning apparatus according to claim 5 wherein said first liquid is detergent and clean water and said second liquid is clean water.

7. The cleaning apparatus according to claim 5 wherein said hand grip includes a lockout device that can be selectively actuated to prevent said hand grip from being moved along said handle to one of said distance in said first direction to activate said first source to supply said first liquid to said distributor and said distance in said second direction to activate said second source to supply said second liquid to said distributor.

8. The cleaning apparatus according to claim 8 wherein said hand grip includes a locking device, said hand grip selectively locking said hand grip to said handle such that said hand grip is prevented from moving along said handle said distance in said first direction and said distance in said second direction.

9. The cleaning apparatus according to claim 8 wherein said locking device includes a control lever pivotally mounted to said hand grip, said control lever having a protrusion, said protrusion engaging an aperture formed in said handle to lock said hand grip to said handle.

10. The cleaning apparatus according to claim 1 wherein said activating device includes a detecting unit operatively connected to said hand grip, said detecting unit outputting a control signal for activating said first source to supply said first liquid to said distributor in response to said hand grip moving said distance along said handle in said first direction.

11. The cleaning apparatus according to claim 10 including a second source for supplying a second liquid to said distributor, said detecting unit outputting a second control signal for activating said second source to supply said second liquid to said distributor in response to said hand grip being moved a second distance along said handle in a second direction opposite said first direction in response to said floor-engaging portion being moved in said second direction.

12. The cleaning apparatus according to claim 11 wherein said detecting unit comprises a hall effect sensor and a magnet, said magnet having north and south magnetic poles, said magnet being secured to said hand grip and positioned with respect to said hall sensor such that said hand grip reciprocally moves said magnet so that said hall sensor positions between said north and south magnetic poles during the movement of said magnet, said hall effect sensor outputs said first mentioned control signal upon being positioned at one of said north magnetic pole and said south magnetic pole, and said hall sensor outputs a second control signal upon being positioned away from said one of said north magnetic pole and said south magnetic pole.

13. The cleaning apparatus according to claim 1 wherein said cleaning apparatus is a carpet extractor and said surface is carpeted.

14. A cleaning apparatus for cleaning a surface in which cleaning solution is dispensed to the surface and substantially simultaneously extracted along with the dirt on the surface in a continuous operation comprising:

a) a floor-engaging portion for moving along said surface;

b) a distributor;

c) a first source for supplying a first liquid to said distributor, said distributor being operatively connected to said floor-engaging portion for distributing said first liquid from said first source onto said surface;

d) an activating device operatively connected to said first source to activate said first source to supply said first liquid to said distributor to distribute said first liquid onto said surface in response to said floor-engaging portion being moved in a first direction; and wherein said activating device includes an engaging member rotatably connected to said floor-engaging portion and extending to said surface, said engaging member bearing against said surface and causing said engaging member to rotate in one direction to activate said first source to supply said first liquid to said distributor upon said floor-engaging portion being moved in said first direction.

15. The cleaning apparatus according to claim 14 including a second source for supplying a second liquid to said distributor, and said floor-engaging portion being moved in a second direction opposite said first direction thereby causing said engaging member to rotate in the other direction and activate said second source to supply said second liquid to said distributor.

16. A cleaning apparatus for cleaning a surface in which solution is dispensed to the surface and substantially simultaneously extracted along with the dirt on the surface in a continuous operation comprising:

a) a floor-engaging portion for movement along the surface;

b) a liquid distribution system operatively connected to said floor-engaging portion, said liquid distribution system including a distributor for dispensing liquid on said cleaning surface, said liquid distribution system supplying at least a first liquid and a second liquid to said distributor;

c) an activating device operatively connected to said liquid distribution system to activate said liquid distribution system to supply at least one of said first liquid and said second liquid to said distributor; and d) wherein moving the floor-engaging portion in a first direction places said activating device in a first state which activates said liquid distribution system to supply said first liquid to said distributor and moving the floor-engaging portion in a second direction opposite said first direction places said activating device in a second state which activates said liquid distribution system to supply said second liquid to said distributor.

17. The cleaning apparatus of claim 16 further comprising a handle operatively connected to said floor-engaging portion, said activating device includes a hand grip movably mounted to said handle, said hand grip being moved a distance along said handle in said first direction to place said activating device in said first state, said hand grip being moved a distance along said handle in said second direction to place said activating device in said second state.

18. The cleaning apparatus of claim 16 wherein said activating device includes an engaging member movably connected to said floor-engaging portion and contacting said surface, wherein moving said floor-engaging portion in said first direction moves said engaging member to a first position to place said activating device in said first state and moving said floor-engaging portion in said second direction moves said engaging member to a second position to place said activating device in said second state.

19. The cleaning apparatus of claim 16 including a fluid release valve operatively connected to said distributor to selectively allow the liquid to flow to the distributor.

20. The cleaning apparatus of claim 19 including a handle pivotally connected to said floor-engaging portion, a trigger switch connected to said handle and operatively connected to said fluid release valve to selectively operate said valve.

21. The cleaning apparatus of claim 16 wherein said first liquid is clean water mixed with detergent and said second liquid is clean water.

22. The cleaning apparatus of claim 21 wherein said liquid distribution system includes a clean water tank and a detergent tank.

23. The cleaning apparatus of claim 16 wherein said activating device includes a detecting system, said detecting system outputting a first control signal to activate said liquid distribution system to supply said first liquid to said distributor in response to said detecting system detecting said floor-engaging portion being moved in said first direction, said detecting system outputting a second control signal to activate said liquid distribution system to supply said second liquid to said distributor in response to said detecting unit detecting said floor-engaging portion being moved in said second direction.

24. The cleaning apparatus of claim 16 wherein said activating device includes an actuating part, wherein moving said floor-engaging portion in said first direction actuates said actuating member to place said activating device in said first state and moving said floor-engaging portion in said second direction actuates said actuating member to place said activating device in said second state.

* * * * *